US010530075B2

(12) United States Patent
Lutz et al.

(10) Patent No.: US 10,530,075 B2
(45) Date of Patent: Jan. 7, 2020

(54) SPECIALIZED ELECTRICAL TERMINAL

(71) Applicant: PerfectVision Manufacturing, Inc., Little Rock, AR (US)

(72) Inventors: William Lutz, Little Rock, AR (US); Larry Heiss, Little Rock, AR (US)

( * ) Notice: Subject to any disclaimer, the term of this patent is extended or adjusted under 35 U.S.C. 154(b) by 0 days.

(21) Appl. No.: 16/028,690

(22) Filed: Jul. 6, 2018

(65) Prior Publication Data

US 2019/0157779 A1 May 23, 2019

Related U.S. Application Data

(60) Provisional application No. 62/588,611, filed on Nov. 20, 2017.

(51) Int. Cl.

| | |
|---|---|
| ***H01R 11/12*** | (2006.01) |
| ***H01R 4/58*** | (2006.01) |
| *H01R 4/20* | (2006.01) |
| *H01R 4/18* | (2006.01) |

(52) U.S. Cl.

CPC ..... *H01R 11/12* (2013.01); *H01R 4/58* (2013.01); *H01R 4/183* (2013.01); *H01R 4/20* (2013.01)

(58) Field of Classification Search

CPC ..... H01R 11/12; H01R 4/183; H01R 4/20; H01R 4/58; H01R 4/30

USPC ..... 439/877, 878, 364, 781, 868, 883

See application file for complete search history.

(56) References Cited

U.S. PATENT DOCUMENTS

| | | | | |
|---|---|---|---|---|
| 3,534,318 A * | 10/1970 | O'Leary | ..... | H01R 13/648 439/861 |
| 5,575,697 A * | 11/1996 | Kaedei | ..... | H01R 11/12 439/868 |
| 5,759,056 A * | 6/1998 | Costello | ..... | H01R 11/12 439/290 |
| 7,160,157 B1 * | 1/2007 | Jones, III | ..... | H01R 11/01 439/288 |
| 2015/0064989 A1 * | 3/2015 | Hirasawa | ..... | H01R 4/305 439/781 |

* cited by examiner

*Primary Examiner* — Travis S Chambers
(74) *Attorney, Agent, or Firm* — David L. Gershner

(57) ABSTRACT

An electrical terminal configured to mate with the cover of an electrical receptacle and the screw which secures the cover to the receptacle in order to ground installed satellite television systems to a properly grounded receptacle.

7 Claims, 3 Drawing Sheets

SPECIALIZED ELECTRICAL TERMINAL

PRIORITY CLAIM

This utility patent application is based upon and claims priority from previously filed U.S. Provisional Patent application entitled "Specialized Electrical Terminal," bearing application No. 62/588,611 filed on Nov. 20, 2017 by inventors William Lutz and Larry Heiss.

BACKGROUND OF THE INVENTION

The invention relates to the field of electrical wiring. More particularly, the present invention relates to terminals to be placed on the ends of electrical wires.

When a satellite television dish is installed it should be electrically grounded. Typically, the dish is bonded to the service ground. However, if the dish and the supporting mast are entirely within the building's zone of protection, bonding to the service ground is not necessary. The zone of protection is discussed in the National Electrical Code and is a concept known by individuals skilled in the relevant art. In such a case where the dish is not bonded to the service ground, the set top box and coaxial cable braid are bonded to the ground.

One way of accomplishing a proper ground is to run a jumper connected to the F port of the set top box via a properly installed F connector, which makes contact with coaxial cable braid, and connect it to a properly grounded electrical receptacle. The least intrusive point of contact to the receptacle is the screw which attaches the receptacle cover to the receptacle. Common wire terminals are not ideal for this application as the conical shape of the countersunk screw heads, which are typical of receptacle covers, acts to force the terminal ends apart as the screw is tightened. Further, a proper electrical connection is difficult to achieve as the screw heads are often painted to match the color of the cover

SUMMARY OF THE INVENTION

The present invention is an electrical terminal which has been designed to be attached to the end of an electrical wire and to mate with an electrical receptacle via the screw which attached the receptacle cover.

The advantages of the present invention include, without limitation, that it is simple in its installation and use and provides a substantially more secure attachment to an electrical receptacle for grounding than common electrical terminals. The use of a terminal with protrusions on one side and chamfered portions on the opposing side allows for a secure engagement of the terminal to the receptacle cover and screw, and the spur allows for better electrical conductivity by scraping the paint off the screw head to allow metal to metal contact from the terminal, through the screw, to the properly grounded receptacle.

DETAILED DESCRIPTION OF THE INVENTION

Figure 1:
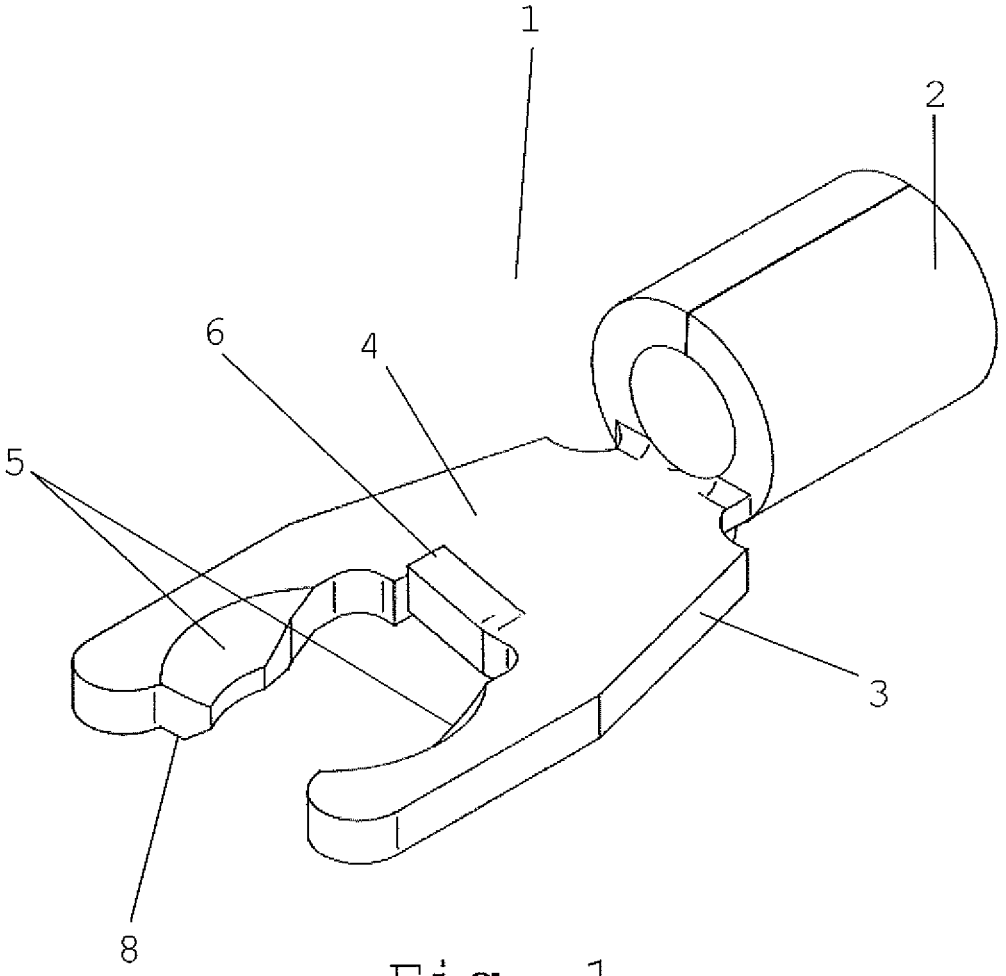
FIG. 1 is an orthogonal view of the terminal.
Figure 2:
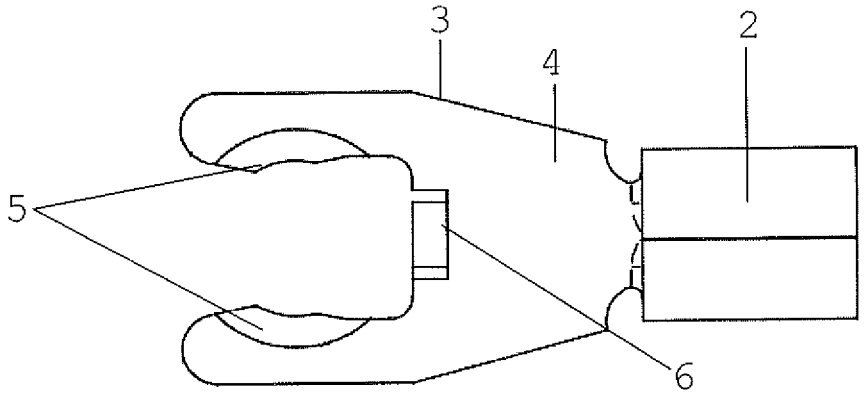
FIG. 2 is a view of the top side of the terminal.
Figure 3:
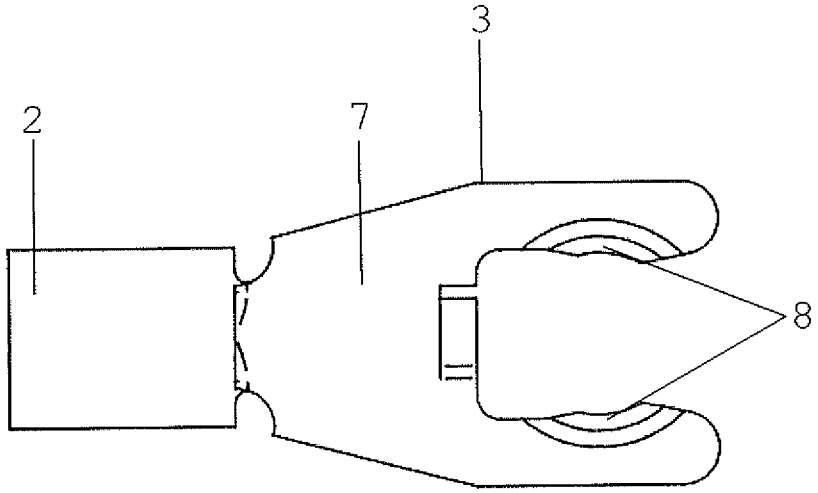
FIG. 3 is a view of the bottom side of the terminal.
Figure 4:
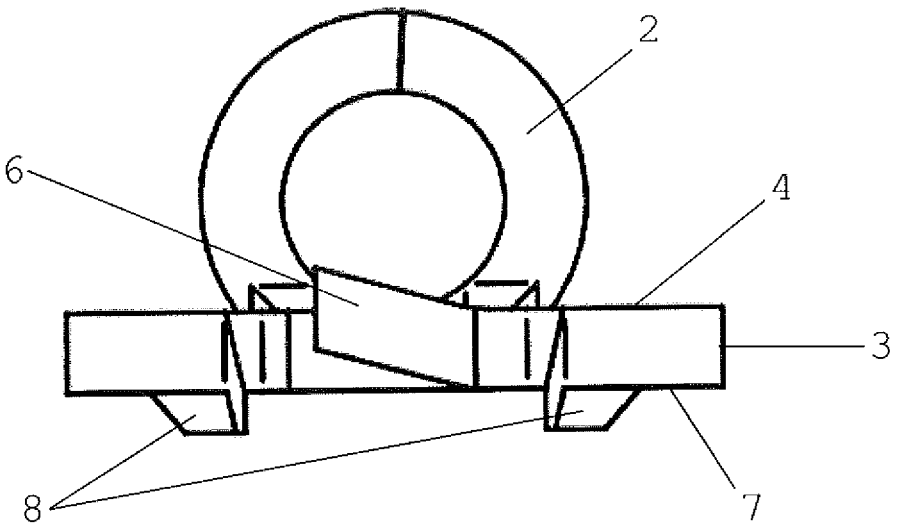
FIG. 4 is a an end view of the terminal.
Figure 5:
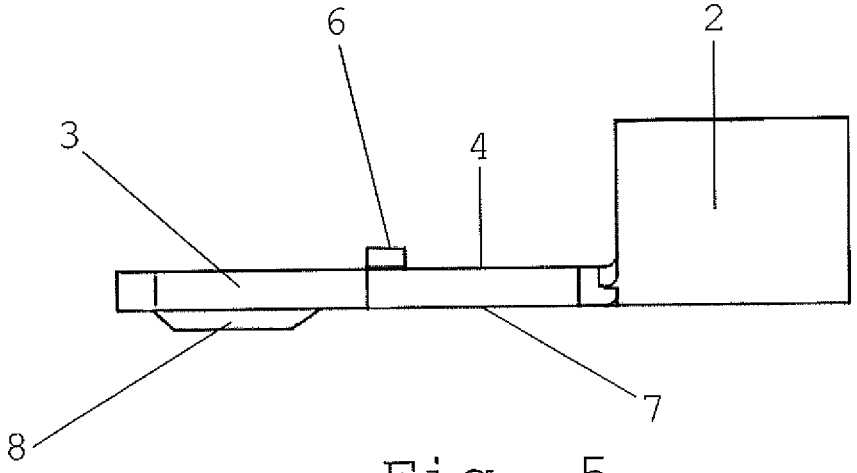
FIG. 5 is a side view of the terminal.

Referring to the drawings, FIG. 1-5 depicts an electrical terminal 1 featuring a collar 2, a terminal end 3, a top side 4 featuring chamfers 5 and a spur 6, and a bottom side 7 with protrusions 8.

The collar 2 is a portion of the terminal which is generally cylindrical and into which a prepared wire is inserted and which is then crimped around the wire to secure the wire to the terminal. The electrical terminal 1 also includes a terminal end 3 which is configured to be attached to a surface via a screw. The terminal end 3 is substantially flat. The preferred shape of the terminal end 3 is a U shape similar to that utilized by commonly available spade or fork terminals. However, the terminal end 3 may also be circular, similar to the shape of commonly available ring terminals. The terminal is electrically conductive and is preferably metallic, though it may be made from an electrically conductive polymer.

The terminal end 3 has a top side 4 which is configured to contact a screw head when the terminal is in use. The top side 4 has one or more chamfers 5 proximate the open portion of the terminal. In a spade or fork type terminal, the open portion is within the U of the terminal. In a ring type terminal, the open portion is the center of the circular ring. The chamfers 5 are configured such that they mate with the conical, countersunk screw head which is used with receptacle covers.

The top side also features a spur 6 which protrudes beyond the adjacent portions of the top side and has a sharp or angled top most edge. The spur 6 is configured to make contact with the underside of a screw head during installation such that, as the screw is tightened, the screw head will scrape along the spur's edge and any paint or surface coatings will be scraped from the underside of the screw head. The spur 6 is preferably attached to the terminal end via a single side such that, when a screw is tightened onto the terminal, the spur 6 may deflect toward the top side 4 of the terminal end 3 until it is substantially level with the top side 4. It is also preferable that the spur 6 be configured to return to its position which protrudes above the top side 4 once the screw is loosened or removed.

The terminal end 3 also has a bottom side 7 which is configured to contact the surface of a receptacle cover when the terminal 1 is in use. The bottom side 7 has one or more protrusions 8 proximate the open portion of the terminal 1. In a spade or fork type terminal, the open portion is within the U of the terminal. In a ring type terminal, the open portion is the center of the circular ring. The protrusions 8 are directly opposite the chamfers 5 located on the tope side 4 of the terminal. The protrusions 8 are preferably beveled such that the outermost surfaces are angled to approximate the countersunk screw hole of a receptacle cover.

To operate the preferred embodiment, a wire is prepared by stripping the insulating jacket from the end of the wire such that the conductive portion of the wire is exposed. The prepared end of the wire is then inserted into the collar 2 of the electrical terminal 1. The collar 2 is then crimped around the wire such that the collar 2 is secured around the wire such that the wire may not easily be removed from the terminal and such that the collar 2 is in contact with the conductive portion of the wire. The terminal end 3 is then placed in contact with the cover of an electrical receptacle to where the protrusions 8 on the bottom side 7 of the terminal end 3 are positioned in the screw hole of the receptacle cover. The receptacle cover screw is then inserted through the terminal end 3 and into the screw hole of the cover until it engages the threads in the receptacle. The screw is then tightened until it comes into contact with the spur 6. The screw should be further tightened while the contact with the spur 6 scrapes any paint, coatings or contaminants from the underside of the screw head and until the underside of the screw head engages with the chamfers 5 on the top side 4 of the terminal end 3. When fully installed the terminal 1 should be securely attached to the receptacle cover and should not readily disengage.

Where the electrical terminal 1 is configured as a spade or fork terminal, the screw does not need to be removed from the receptacle and receptacle plate. The screw may be loosened to such a degree that the terminal may be inserted into the space between the bottom of the screw head and the surface of the receptacle cover. Then the screw is tightened such that it engages the spur 6 to remove any paint, coating, or contaminant and engages the chamfers 5 on the top side 4 of the terminal end 3.

What is claimed is:

1. An electrical terminal comprising:

a collar configured to be crimped around a wire;

a substantially flat terminal end which has a top side and a bottom side;

said top side comprising one or more chamfers and a spur located proximate said chamfers and which protrudes above the surface of said top side; and said bottom side comprising one or more protrusions located opposite the chamfers on said top side;

configured such that the chamfers mate with a conical screw head;

configured such that said spur is the only element of the substantially flat terminal end which extends above the top side of said substantially flat terminal end; and configured such that said spur is a separate structure from said chamfers and protrusions; and wherein said collar is configured such that it does not extend below the bottom side of said substantially flat terminal end.

2. An electrical terminal as described in claim 1 wherein said terminal is a spade terminal.

3. An electrical terminal as described in claim 1 wherein the spur is configured to deflect when force is applied to it.

4. An electrical terminal as described in claim 3 wherein said terminal is metal.

5. An electrical terminal as described in claim 3 wherein said terminal is a spade terminal.

6. An electrical terminal as described in claim 1 wherein said terminal is metal.

7. An electrical terminal as described in claim 6 wherein said terminal is a spade terminal.

* * * * *